US007002091B2

(12) United States Patent
Hoser et al.

(10) Patent No.: US 7,002,091 B2
(45) Date of Patent: Feb. 21, 2006

(54) SHAVING HEAD CLEANER

(75) Inventors: Jurgen Hoser, Neu-Anspach (DE); Diana Kappes, Eppstein (DE); Andreas Larscheid, Kelkheim-Fischbach (DE); Uwe Ludascher, Frankfurt (DE); Svatopluk Krumnikl, Kronberg (DE)

(73) Assignee: Braun GmbH, Kronberg (DE)

( * ) Notice: Subject to any disclaimer, the term of this patent is extended or adjusted under 35 U.S.C. 154(b) by 0 days.

(21) Appl. No.: 11/060,186

(22) Filed: Feb. 17, 2005

(65) Prior Publication Data

US 2005/0189207 A1 Sep. 1, 2005

Related U.S. Application Data

(63) Continuation of application No. PCT/EP03/06738, filed on Jun. 26, 2003.

(30) Foreign Application Priority Data

Aug. 17, 2002 (DE) ..... 102 37 741

(51) Int. Cl.
*H01H 13/14* (2006.01)

(52) U.S. Cl. ..... 200/520; 200/523

(58) Field of Classification Search ..... 200/51 R, 200/51.16, 51.09, 520–524; 134/166 R, 134/169 R, 135, 170
See application file for complete search history.

(56) References Cited

U.S. PATENT DOCUMENTS

| | | | | |
|---|---|---|---|---|
| 1,865,289 | A * | 6/1932 | Trowbridge | 134/103.1 |
| 5,649,556 | A | 7/1997 | Braun | |
| 6,305,391 | B1 * | 10/2001 | Hoser | 134/111 |
| 6,305,394 | B1 * | 10/2001 | Reese | 135/20.1 |
| 6,371,136 | B1 | 4/2002 | Hoser | |
| 2005/0034313 | A1 * | 2/2005 | Hoser et al. | 30/457 |
| 2005/0045204 | A1 * | 3/2005 | Hoser et al. | 134/13 |
| 2005/0126610 | A1 * | 6/2005 | Hoser | 134/95.2 |

* cited by examiner

*Primary Examiner*—Michael Friedhofer
*Assistant Examiner*—Lisa Klaus
(74) *Attorney, Agent, or Firm*—Fish & Richardson P.C.

(57) ABSTRACT

A shaving head cleaner includes a housing defining a receptacle adapted to receive a shaving head of the dry shaving apparatus. A contact member extends from the housing, and is adapted to accommodate an end of the dry shaving apparatus remote from the shaving head. A pushbutton is positioned near an end of the contact member, and the pushbutton has electrical connectors configured to be moved by the pushbutton for establishing an electrical connection between the dry shaving apparatus and the shaving head cleaner. A tolerance compensating device is arranged between the electrical connectors and the pushbutton.

23 Claims, 5 Drawing Sheets

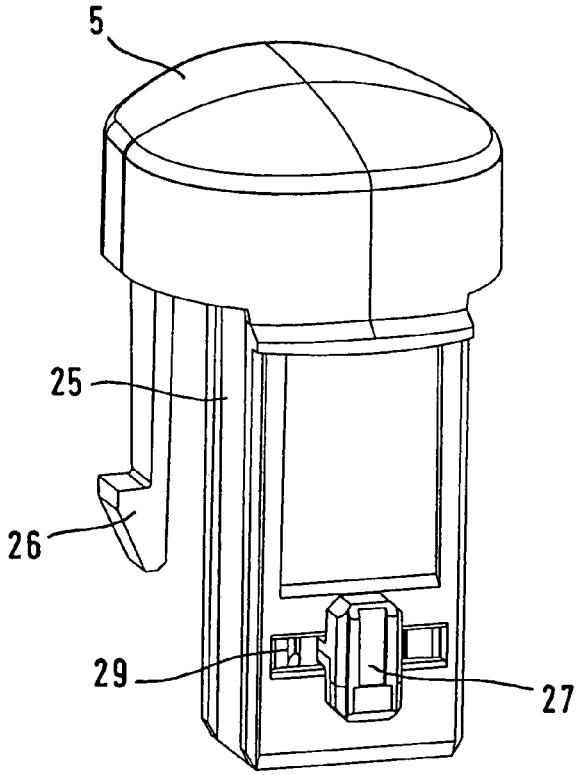
Fig. 5
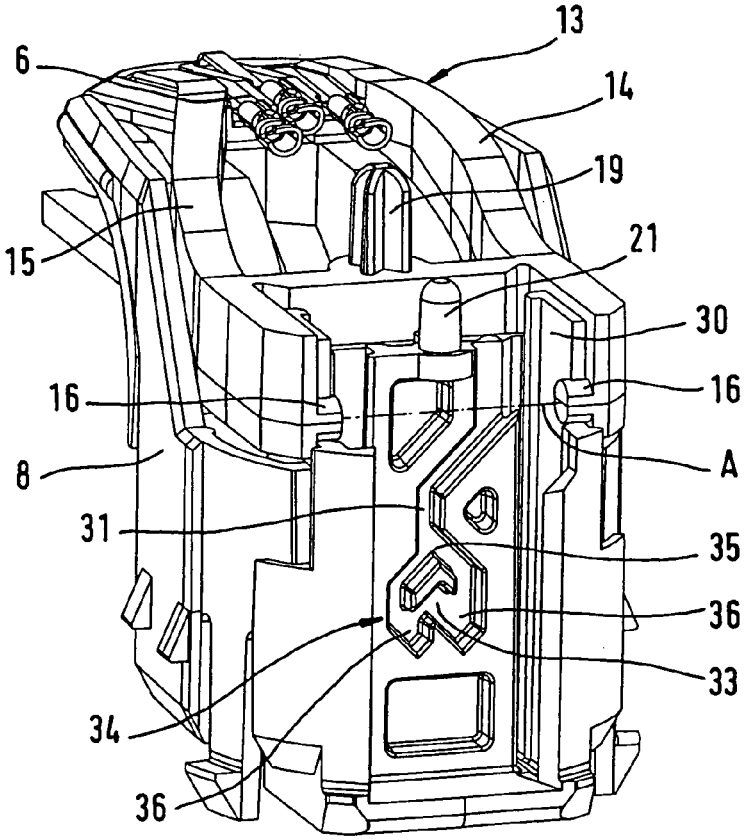

SHAVING HEAD CLEANER

CROSS-REFERENCE TO RELATED APPLICATIONS

This is a continuation of PCT Application No. PCT/EP2003/006738, filed on Jun. 26, 2003, which claims priority to German Patent Application No. 102 37 741.3, filed on Aug. 17, 2002, each of which is incorporated herein by reference in its entirety.

TECHNICAL FIELD

This invention relates to shaving head cleaners.

BACKGROUND

Devices have been developed for cleaning the shaving head of a dry shaving apparatus. DE 44 02 237 C1, for example, describes a cleaning device for cleaning a shaving head of a dry shaving apparatus. The shaving head of the dry shaving apparatus is inserted into a receptacle, which is subsequently filled with a cleaning fluid. The cleaning fluid dislodges and carries away hair residues and deposits adhering to the shaving head. To enhance the cleaning effect, the dry shaving apparatus is temporarily activated during the cleaning process. To enable activation of the dry shaving apparatus during the cleaning process, the dry shaving apparatus is electrically connected to the cleaning device.

The electrical connection between the cleaning device and the dry shaving apparatus is accomplished by means of contact pins of the dry shaving apparatus which are connected to electrical connectors of the cleaning device. The electrical connectors are arranged in the upper end of a contact member and can be moved in the direction of the contact pins by means of a pushbutton. Upon reaching the contact pins, the electrical connectors are held in position by detent hooks. The dry shaving apparatus is thus electrically connected to and locked in the cleaning device. The structural design of the contact member with its movable part is relatively complex. Consequently, manufacture and/or assembly of the contact member can be relatively complicated. In addition, the contact pins of the dry shaving apparatus have a tendency to become dislocated from their original position after time. Such dislocations, for example, can be the result of manufacturing tolerances of the cleaning device and the dry shaving apparatus. Dislocations can also result from slight variances in the positioning of the dry shaving apparatus when inserted into the cleaning device. Though only slight, these variances can result in forces that act on the electrical connectors while connecting the electrical connectors to the electrical pins of the dry shaving apparatus, and may expose the contact member to high mechanical loads. In particular, the detent hooks are subjected to these mechanical loads. Such loads may increase wear. Under adverse circumstances, wear may be so severe that the contact member is prevented from latching reliably with prolonged use of the cleaning device, whereby at worst electrical contacting of the dry shaving apparatus is no longer possible.

SUMMARY

According to one aspect of the invention, a cleaning device includes a tolerance compensating device arranged between electrical connectors and a pushbutton.

The tolerance compensating device enables compensation for manufacturing tolerances and tolerances resulting from improperly inserting a dry shaving apparatus into the cleaning device. The tolerance compensating device prevents a direct connection between the pushbutton and the electrical connectors. Consequently, the pushbutton movement is decoupled from the movement of the electrical connectors. High plugging forces associate with electrically connecting the dry shaving apparatus to the electrical connectors can also be prevented. As a result, the loads acting on the electrical connection and the contact member can be reduced significantly. In particular, the detent elements can be exposed to less severe mechanical loads, which can lead to a substantially prolonged service life of the locking mechanism.

In an advantageous aspect, the tolerance compensating device is a spring-loaded rocker on which the electrical connectors are arranged. The rocker is mechanically connected to the pushbutton by way of the spring. The rocker cooperates through the spring with the pushbutton for creating electrical contact between the electrical connectors and the dry shaving apparatus (e.g., contact pins of the dry shaving apparatus). The electrical connectors, which are arranged on the rocker, serve to establish contact with the dry shaving apparatus. By actuating the pushbutton, the rocker, along with its electrical connectors, is moved in the direction of the contact pins of the dry shaving apparatus. When, due to tolerances, contact is made before the pushbutton reaches its latch stop, the spring on the rocker allows the pushbutton to continue its movement, while the rocker, as a result of the contact forces of the electrical connectors, remains in its position. The pushbutton is then moved against the spring until it reaches its latch stop. As a result of its relatively small number of parts, the tolerance compensating device requires little assembly effort, which can make it a particularly low-cost item.

In some embodiments, the rocker is mounted for pivotal movement with the contact member or a component arranged within the contact member. The contact member as a mount for the rocker has proven to be suitable because of the particular ease with which a bearing for the rocker can be provided at this site. Moreover, this has the advantage of enabling the continued use of an already present contact member with minor modifications. Still further, the contact member is a component of sufficient strength so that the bearing does not generally need any additional reinforcements of the contact member.

In another aspect, the bearing may be arranged on a component provided within the contact member. Consequently, the component can be fitted to suit the rocker.

The pushbutton may possess elements for constraining the rocker to follow it in its movement. In some embodiments, the pushbutton includes hooks engaging behind the rocker.

The spring between the pushbutton and the rocker may be arranged loosely between the two components or, alternatively, may have one of its ends connected with the rocker or the pushbutton. These configurations require relatively little assembly effort. By contrast, a spring having both its ends fixed enables the rocker to follow the movement when the pushbutton is moved. Otherwise follower elements (e.g., hooks) can be arranged on the pushbutton or the rocker to cause the rocker to move along with the pushbutton.

Where spiral springs are used, it is advantageous to guide the spring on the rocker or in the pushbutton. This secures the spring against jamming and provides improved protection from damage.

By suitably selecting the arrangement of the pushbutton acting through the spring and the electrical connectors on the rocker, a wide variety of arrangements can be realized. In an advantageous configuration, the pushbutton acts between the electrical connectors and the pivot point of the rocker. In this configuration the pushbutton travels a short distance before contacting, while the electrical connectors travel a longer distance. Depending on the length of the rocker, a corresponding stroke length can be used for contacting and for the compensation of tolerances. This enables the stroke of the pushbutton to be designed as in existing cleaning devices so that the user can operate the new cleaning device in the conventional manner.

In another configuration the electrical connectors are arranged between the pivot point of the rocker and the pushbutton acting via the spring, so that the pushbutton travels a longer distance than the electrical connectors. This arrangement affords advantages in cases where small and delicate contacts are used, because it enables gentler contacting.

The electrical connectors may be sheet-metal contacts which are arranged on the rocker. In some embodiments, the sheet-metal contacts have one of their ends fixedly mounted.

The sheet-metal contacts may be fixed to the rocker by means of a latch or plug connection. In cases where the rocker is injection molded from a plastics material, the plastics material may be injection molded around the sheet-metal contacts to fix them on the rocker.

For protection against damage, the rocker is constructed such that each of the sheet-metal contacts is arranged in its respective recess within the rocker. Arranging the connectors individually has the added advantage of compensating for height tolerances between the contact pins of the dry shaving apparatus.

It has proven to be advantageous for the sheet-metal contacts to have an elastic region in the direction of the contact pins to be contacted. This enables the sheet-metal contacts to compensate for tolerances and support the effect of the tolerance compensating device.

In a further configuration the sheet-metal contacts have hooks cooperating with stops on the rocker. The hooks limit the stroke of the sheet-metal contacts, causing the sheet-metal contacts to move within the reversibly deformable range.

To help to ensure reliable contacting of the dry shaving apparatus for the cleaning process, the electrical connectors are locked during this period. Aside from ensuring contacting, any accidental removal of the dry shaving apparatus from the cleaning device is prevented at the same time. The locking mechanism used for this purpose includes two latch stops. At the first latch stop the electrical connectors are completely received within the contact member, and the dry shaving apparatus can be inserted into the cleaning device. At the second latch stop the electrical connectors are connected to the contact pins of the dry shaving apparatus. At both latch stops the electrical connectors are held in their respective position.

The locking mechanism is of particularly simple design if the pushbutton for movement of the electrical connectors is an actuating element for the locking mechanism. For this purpose, the pushbutton is equipped with a slide that is movable between the two latch stops along a guide. With the slide following the movement of the pushbutton, a rectilinear movement of the slide can be produced. The design possibilities for the locking mechanism can be increased considerably by arranging the slide for movement in a direction transverse to the direction of movement of the pushbutton. In this way two-dimensional guides can be realized.

A particularly simple construction of the guide is obtained by aligning it essentially transverse to the movement of the pushbutton. The first latch stop can be formed by the upper end of the guide or by the upper housing boundary. An elaborate design of the latch stop can be avoided if the pushbutton and hence the slide are held at this latch stop by means of a spring. The second latch stop is arranged underneath the first latch stop. In order to ensure that the slide moved against the spring is received reliably, a lower latch stop has proven advantageous, which is formed within a curvilinear portion of the guide (e.g., heart-shaped curve portion) known as a control slideway. After the latch stop has been reached, by reversal of the direction of movement of the slide, the restoring force of the spring ensures a secure seat of the slide in the heart-shaped curve portion of the guide. Furthermore, due to the characteristic of the heart-shaped curve, the locking engagement provides the user with a tactile signal indicative of the locked condition of the cleaning device.

The guide for the slide may be arranged in a separate component in the contact member. An additional component may be omitted, however, if the guide is arranged in the housing of the contact member. This renders the locking mechanism particularly economical.

In some embodiments, the cleaning device can be constructed in a relatively simple manner. In certain embodiments, the cleaning device can enable reliable contacting of the dry shaving apparatus while reducing the load on the locking mechanism and the contact member.

Other features and advantages of the invention will be apparent from the description, the drawings, and the claims.

DESCRIPTION OF DRAWINGS

FIG. 5 is a perspective view of the tolerance compensating device of FIG. 3.

Like reference symbols in the various drawings indicate like elements.

DETAILED DESCRIPTION

Figure 1:
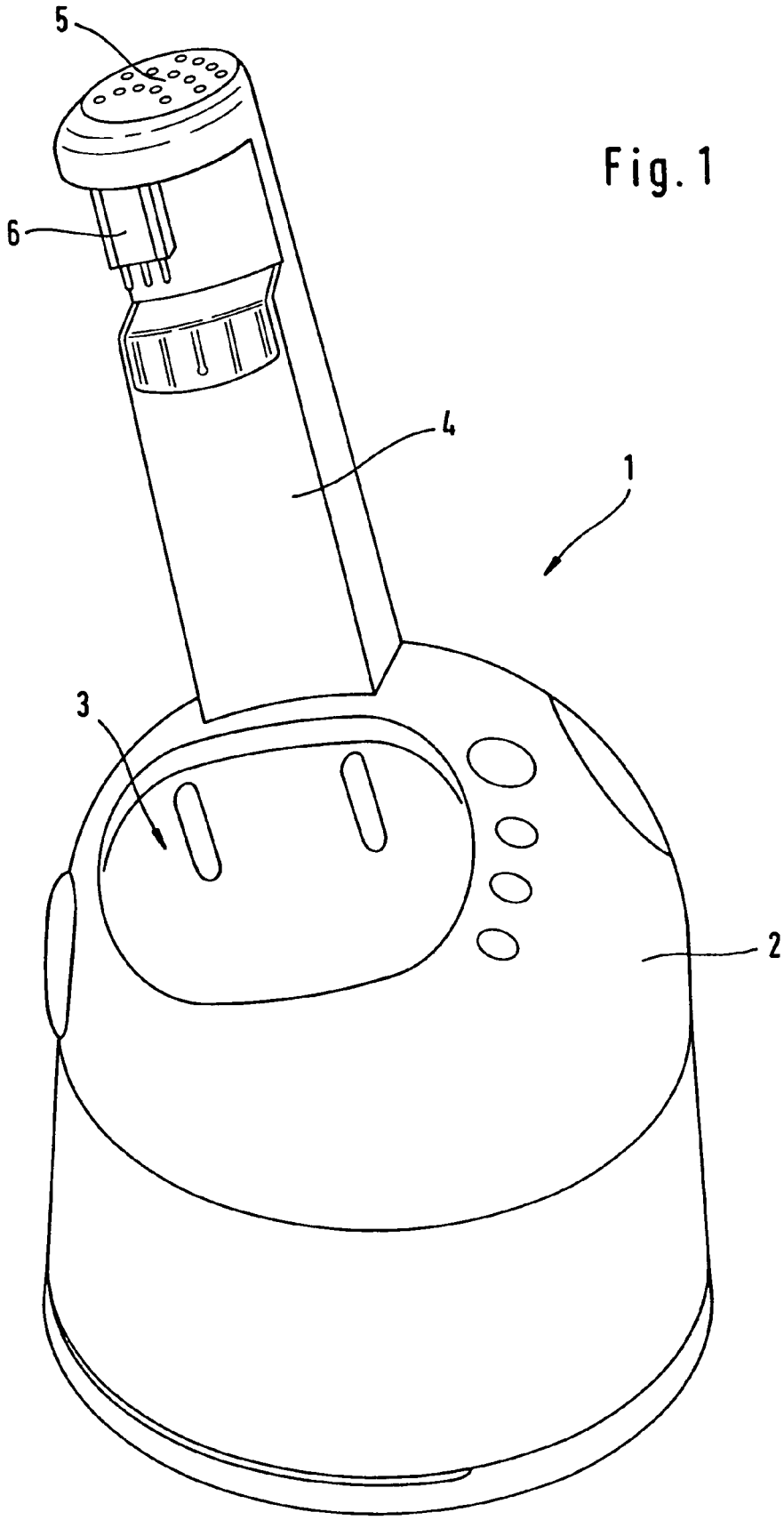
FIG. 1 is a view of a cleaning device.

The cleaning device 1 shown in FIG. 1 has a housing 2. Through an opening 3 in the housing 2, a shaving head of a dry shaving apparatus (not shown) is insertable into a receptacle. The housing 2 accommodates equipment for cleaning the dry shaving apparatus. Disposed on the housing 2 adjacent the opening 3 is a contact member 4, which extends roughly perpendicularly during use of the cleaning device. A pushbutton 5 is located at the upper end of the contact member 4. When the dry shaving apparatus is inserted in the opening 3, the pushbutton 5 rests on the dry shaving apparatus to lock it in place. Actuation of the pushbutton 5 causes sheet-metal contacts 6, illustrated schematically, to be moved downwards until they meet contact pins of the dry shaving apparatus. For illustrative purposes, the sheet-metal contacts 6 are shown as downwardly protruding elements.

Figure 2:
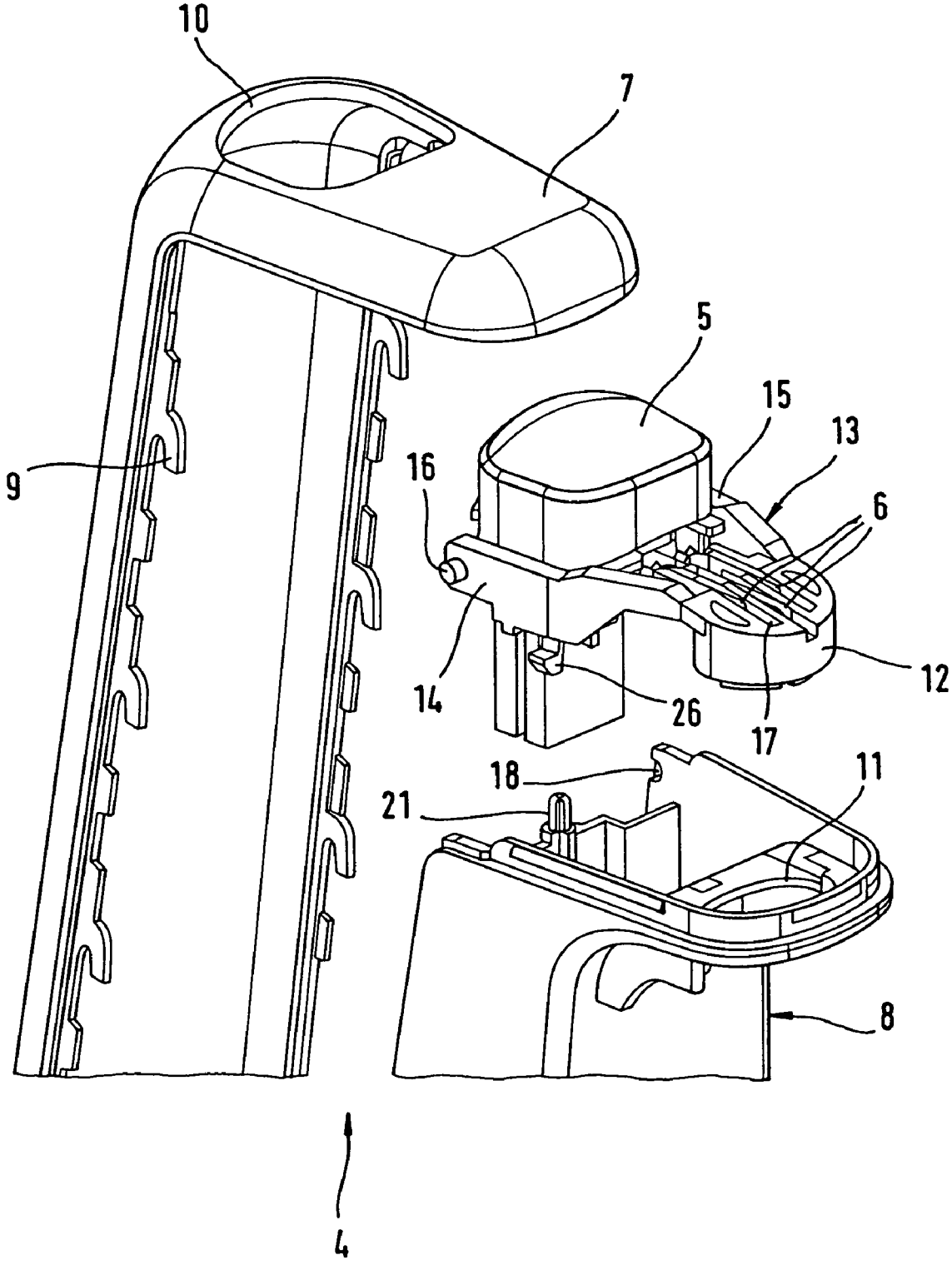
FIG. 2 is a view of the arrangement of a tolerance compensating device in a contact member of the cleaning device of FIG. 1.

The contact member 4 shown in FIG. 2 is composed of two housing parts 7, 8. The housing parts 7, 8 are latched and held together by means of catch hooks 9. The rear housing part 7 has in its upper end region an opening 10 for receiving the pushbutton 5. The pushbutton 5 is guided for vertical movement in the front housing part 8. The front housing part 8 has in its upper end region likewise an opening 11 through which a free end 12 of a rocker 13 extends when the cleaning device 1 is locked. The rocker 13 possesses two bracket arms 14, 15 located on either side of the pushbutton 5. Integrally formed on the ends of the bracket arms 14, 15 remote from the end 12 is a respective journal 16 for providing a pivot for the rocker 13. The end 12 of the rocker 13 has recesses 17, each recess supporting a respective sheet-metal contact 6.

Figure 3:
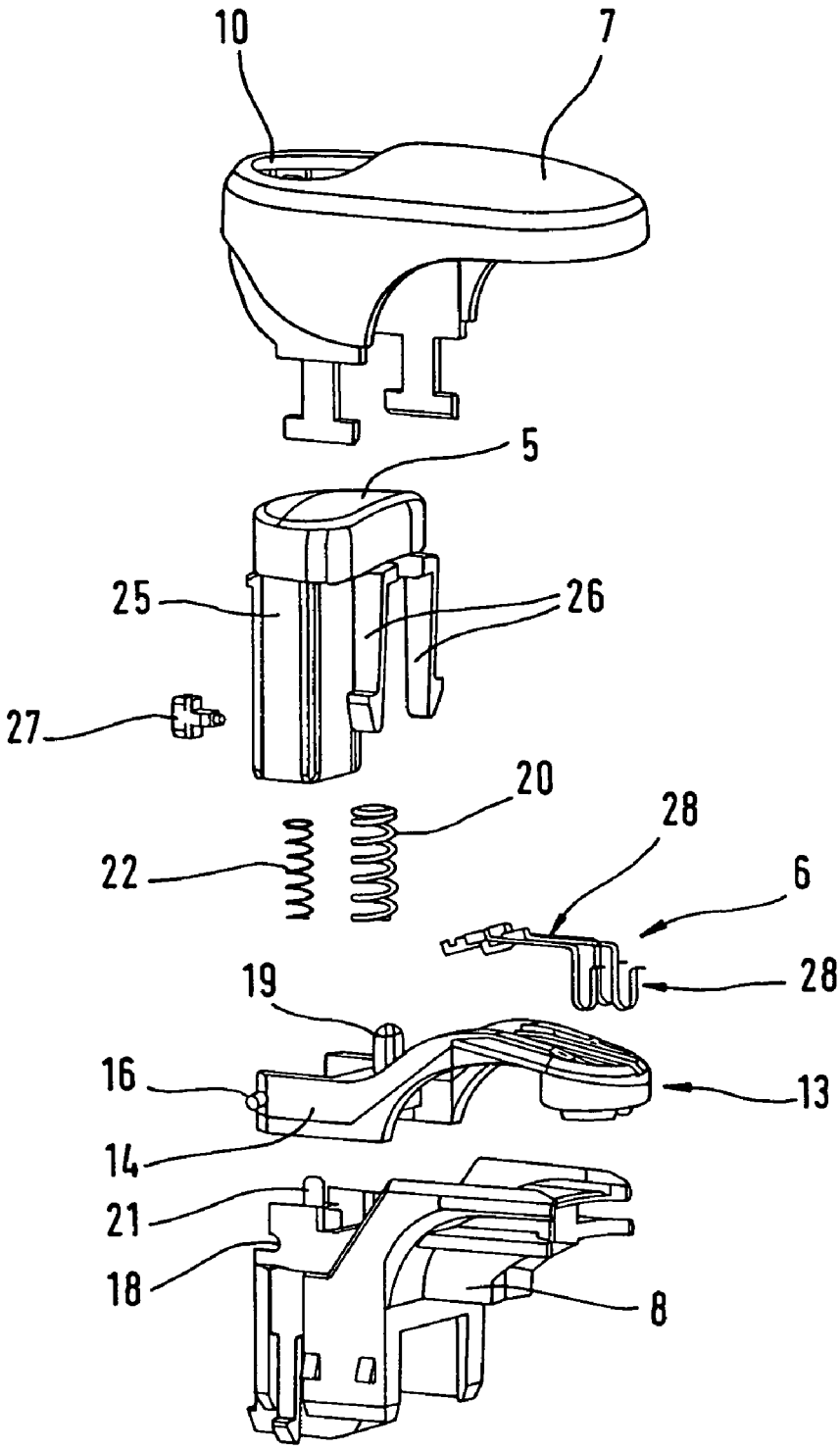
FIG. 3 is an exploded view of the tolerance compensating device of FIG. 2.

FIG 3 is a more detailed representation of a tolerance compensating device. The journals 16 arranged on the bracket arms 14, 15 of the rocker 13 are received by two bearings 18 in the housing part 8, so that the rocker 13 is pivotal. Arranged perpendicularly between the bracket arms 14, 15 is a mount 19 for receiving a spring 20. The spring 20 urges against the pushbutton 5 from below. The housing part 8 likewise has a perpendicular mount 21 providing a guide for another spring 22 which also urges against the pushbutton 5 from below. On the side of the pushbutton 5, both springs 20, 22 are held in receiving sockets 23, 24 (shown in FIG 4) located in the interior of the pushbutton 5.

For vertical movement, the pushbutton 5 has guide elements 25 configured to mate with corresponding structure in the housing part 8. Hooks 26 arranged on the pushbutton 5 embrace the bracket arms 14, 15 of the rocker 13, thus enabling the rocker 13 to follow the upward movement of the pushbutton 5 for unlocking. Arranged on the rear side of the pushbutton 5 is a slide 27. The sheet-metal contacts 6 are connected to the electrical leads (not shown) of the cleaning device 1 by means of terminals.

Figure 4:
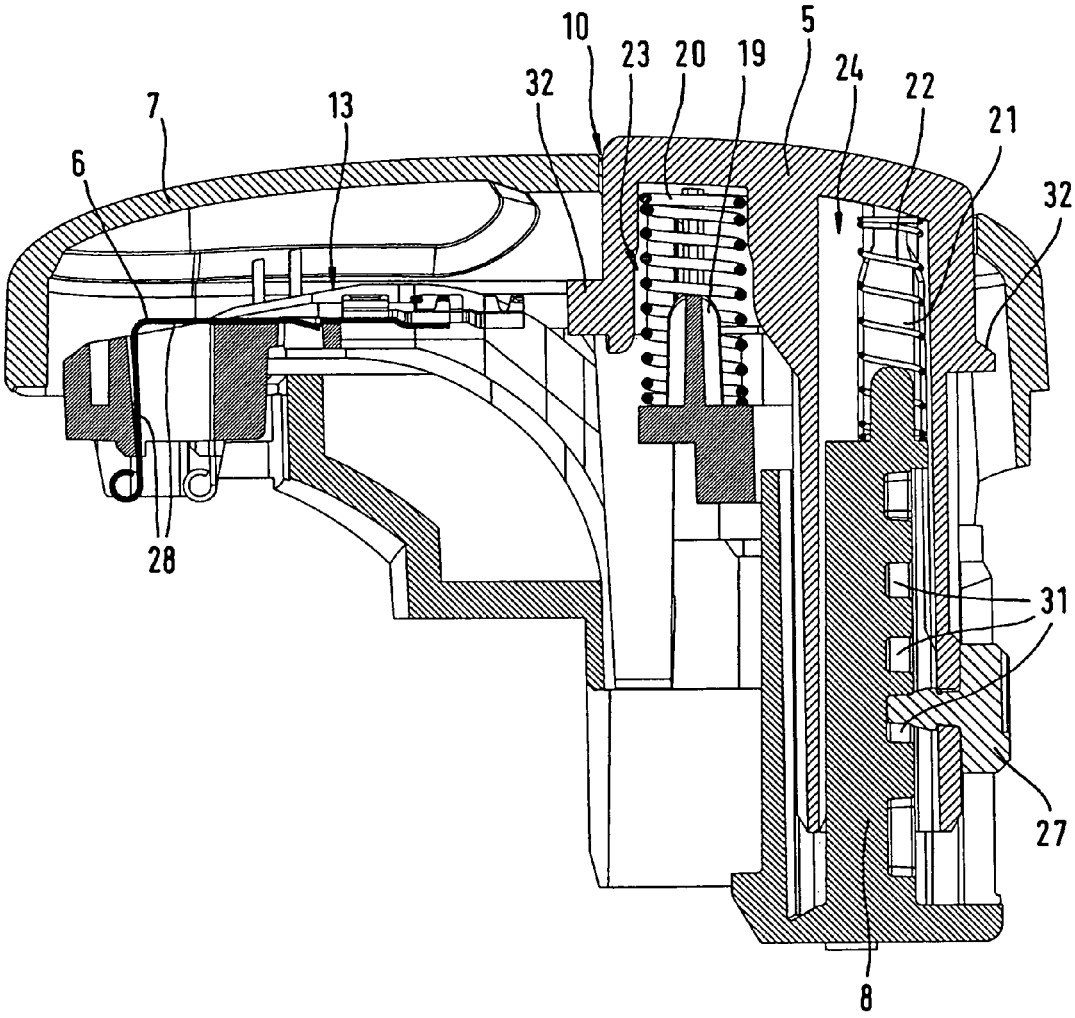
FIG. 4 is a sectional view of the tolerance compensating device of FIG. 2.

The mode of operation of the tolerance compensating device will now be described with reference to FIG. 4. By means of the spring 22 arranged in a receiving socket 24 of the pushbutton 5, the pushbutton 5 is urged upwardly in the direction of the housing part 7 of the contact member 4. When downward force or pressure is applied to the pushbutton 5, the pushbutton moves downwards against the spring 22. As this movement occurs, the spring 20, supported by the rocker 13, bears against the rocker 13, causing it to pivot in counterclockwise direction. As a result, the sheet-metal contacts 6 are moved downwards into contact with the contact pins (not shown) of the dry shaving apparatus (not shown). With contact having been established between the sheet-metal contacts 6 and the contact pins, the pushbutton 5 is moved further downwards. As a result, the rocker 13 remains in its lower position, and the pushbutton 5 is moved against the spring force of the springs 22 and 20. The pushbutton movement is hence independent of the contact-making movement. In the event of the spring 20 being compressed to its solid length, any further movement of the pushbutton 5 in the downward direction would increase the forces acting on the contact pins of the dry shaving apparatus. To prevent this from occurring, the sheet-metal contacts 6 have elastically deformable regions 28 enabling further compensation.

FIG. 5 shows the rear side of the pushbutton 5 having the slide 27 movably arranged in a horizontal slot 29 thereof. The hooks 26 embrace the rocker 13 in the area of the bracket arms 14, 15. With its journals 16, the rocker 13 is carried in the bearings 18 of the housing part 8 and is pivotal about an axis A. The guide elements 25 of the pushbutton 5 run in guideways 30 of the housing part 8. The housing part 8 furthermore possesses a guide 31 into which the slide 27 extends. The upper latch stop, which limits the movement of the pushbutton 5 in the upward direction, is defined by stops 32 that, in this position, engage the housing part 7 in the proximity of the opening 10 under spring load. A lower latch stop 33 is provided in the lower section of the guide 31 configured as a heart-shaped curve 34. For this purpose, the guide groove divides at a point 35 into two grooves extending downwardly at an inclination away from each other. Each groove has a reversal point 36. At this reversal point 36 the two grooves extend inwardly each with a gradient of 45°. Then they ascend upwardly at an inclination towards each other until they meet at a point which represents the latch stop 33 and lies below point 35.

For locking of the cleaning device 1, the pushbutton 5 is moved downwards against the spring 22. In this process, the slide 27 slides likewise downwards in its guide 31. At point 35, the slide 27 continues its inclined downward movement in the one groove, which is the left-hand groove in FIG. 5. The downward movement of the pushbutton 5 is stopped when the reversal point is reached. The user then releases the pushbutton 5 which is moved upwards by the spring 22. On reaching the reversal point, the slide 27 is directed inwardly by the 45° incline of the groove, so that on release of the pushbutton 5 it is situated in that section of the groove that extends towards the lower latch stop 33. The spring 22 urging the pushbutton 5 upwards reliably holds the slide 27 at point 33 between the two inclines, that is, at the latch stop. In this condition the cleaning device 1 is locked. For unlocking of the cleaning device 1, the pushbutton 5 is pressed downwards to cause the slide 27 to be moved downwards in one of the two grooves until the downward movement is stopped by the reversal point 36. The slide 27 is again displaced by the 45° incline, this time to the right, and with the user releasing the pushbutton 5 the slide 27 returns in its guide to the upper latch stop which is reached when the stops 32 engage the housing part 7. Within the guide 31 the slide 27 is above point 35.

A number of embodiments of the invention have been described. Nevertheless, it will be understood that various modifications may be made without departing from the spirit and scope of the invention. Accordingly, other embodiments are within the scope of the following claims.

What is claimed is:

1. A shaving head cleaner for a dry shaving apparatus, the shaving head cleaner comprising:

a housing defining a receptacle adapted to receive a shaving head of the dry shaving apparatus;

a contact member extending from the housing, the contact member being adapted to accommodate an end of the dry shaving apparatus remote from the shaving head;

a pushbutton positioned near an end of the contact member, the pushbutton having electrical connectors configured to be moved by the pushbutton for establishing an electrical connection between the dry shaving apparatus and the shaving head cleaner; and a tolerance compensating device arranged between the electrical connectors and the pushbutton.

2. The shaving head cleaner of claim 1, wherein the tolerance compensating device comprises a rocker on which the electrical connectors are arranged, a spring connecting the rocker to the pushbutton.

3. The shaving head cleaner of claim 2, wherein the rocker is pivotally mounted in the contact member.

4. The shaving head cleaner of claim 2, wherein the rocker is pivotally mounted to a component arranged in the contact member.

5. The shaving head cleaner of claim 2, wherein the pushbutton comprises elements configured to move the rocker in response to movement of the pushbutton.

6. The shaving head cleaner of claim 2, wherein the pushbutton comprises hooks configured to engage the rocker.

7. The shaving head cleaner of claim 2, wherein the spring comprises a spiral spring arranged within a guide of the rocker.

8. The shaving head cleaner of claim 2, wherein the spring comprises a spiral spring arranged within a guide of the pushbutton.

9. The shaving head cleaner of claim 2, wherein the electrical connectors comprise sheet-metal contacts arranged on the rocker.

10. The shaving head cleaner of claim 9, wherein each of the sheet-metal contacts comprises an end fixedly mounted to the rocker.

11. The shaving head cleaner of claim 9, wherein the sheet-metal contacts are fixed to the rocker by means of a latch and plug connection.

12. The shaving head cleaner of claim 9, wherein the sheet-metal contacts are fixed to the rocker by molding thermoplastic material around the sheet-metal contacts.

13. The shaving head cleaner of claim 12, wherein the detent is slidably arranged in a groove.

14. The shaving head cleaner of claim 13, wherein the groove is defined by the contact member.

15. The shaving head cleaner of claim 13, wherein the groove comprises a latching mechanism in at least one of its end regions.

16. The shaving head cleaner of claim 9, wherein the sheet-metal contacts are arranged in a recess defined by the rocker.

17. The shaving head cleaner of claim 16, wherein each sheet-metal contact is arranged in a respective recess.

18. The shaving head cleaner of claim 9, wherein each sheet-metal contact has an elastic region.

19. The shaving head cleaner of claim 1, wherein the pushbutton comprises a detent element adapted to lock the pushbutton in end positions of its travel.

20. The shaving head cleaner of claim 19, wherein the lower latch stop comprises a curvilinear portion.

21. The shaving head cleaner of claim 20, wherein the curvilinear portion is substantially heart-shaped.

22. The shaving head cleaner of claim 19, wherein the detent element is arranged to move in a direction transverse to the movement of the pushbutton.

23. The shaving head cleaner of claim 1, further comprising a spring configured to bias the pushbutton against the contact member.

* * * * *